United States Patent [19]

Luig

[11] 4,118,632

[45] Oct. 3, 1978

[54] NUCLEAR MEDICINE DIAGNOSTIC INSTRUMENT FOR THE DETERMINATION OF THE DISTRIBUTION PATTERN OF A RADIOACTIVE RADIATION SOURCE

[76] Inventor: Heribert Luig, Helmoltstr 7, 34 Güttingen, Fed. Rep. of Germany

[21] Appl. No.: 735,787

[22] Filed: Oct. 26, 1976

[30] Foreign Application Priority Data

Oct. 27, 1975 [DE] Fed. Rep. of Germany ..... 2547981

[51] Int. Cl.[2] ..... G21F 5/04

[52] U.S. Cl. ..... 250/513; 250/505; 250/514

[58] Field of Search ..... 256/505, 511, 512, 513, 256/514

[56] References Cited

U.S. PATENT DOCUMENTS

| | | | |
|---|---|---|---|
| 3,792,273 | 2/1974 | Bergstedt | 250/363 S |
| 3,835,323 | 9/1974 | Kahil | 250/513 |
| 3,982,133 | 9/1976 | Jupa et al. | 250/505 |
| 4,017,730 | 4/1977 | Barrett | 250/505 X |

*Primary Examiner*—Archie R. Borchelt

[57] ABSTRACT

The invention relates to a nuclear medical diagnostic instrument for the determination of the distribution pattern of substances emitting gamma quanta and inserted in a body, which consists essentially of a detector with a localization arrangement and two or more multichannel collimator elements placed in front of the detector.

5 Claims, 16 Drawing Figures

NUCLEAR MEDICINE DIAGNOSTIC INSTRUMENT FOR THE DETERMINATION OF THE DISTRIBUTION PATTERN OF A RADIOACTIVE RADIATION SOURCE

FIELD OF THE INVENTION

This invention lies in the field of Nuclear Medicine and in particular to a nuclear medicine diagnostic instrument for the determination of the distribution pattern of a radioactive radiation source.

DESCRIPTION OF THE PRIOR ART

For examining a living body for internal disturbances and especially for growths or tumors, radioactive nuclides emitting gamma rays (quanta) are incorporated within the body in carefully controlled amounts and in the form of selected chemical compounds containing these nuclides which participate in the normal metabolism of the organs under examination or in the areas of such organs to be investigated by this procedure. These compounds are absorbed and are stored at the sites or the places of disturbance; the radiation or quanta from these sites correspond to an increased or decreased measure of the degree to which the compounds participate in normal or abnormal metabolism. These storage places thereby become sources of gamma radiation of increased—or of intensively decreased radiating environment. The radiation intensity characterizes the site. By detection and measurement and by picture representation of the distribution pattern of the radiation the sites of disturbance in the body or in a part of the body that is to be examined can be accurately diagnosed. By successive measurements and corresponding picture presentations of the variable distribution radiation pattern, one can determine among other things the function and the circulation of organs in question and of the areas of tissue surrounding the organs.

With the known diagnostic instruments, a scintilligraphic representation will be obtained whereby the radiologist is afforded two different technical procedures, one being a detector-type machine, the other being a camera-type machine.

In the detector apparatus the picture is given by a collimated detector sensitive to the gamma quanta from the source and the detector scans the patient by lines in accordance with the known principle operation of the scintilligraphic scanner.

In the camera aparatus, the picture is framed by a fixed camera and by a not moveable camera system which is known as a gamma camera. In both known instruments a multi-channel collimator is employed and it always precedes the detector. The collimator collimates the isotropic radiation to provide substantially parallel rays with the exception of a small solid angle, this small angle starting from a radiation point source lying inside the living body that is being examined. Accordingly, the detector can localize as a point source the location of the source of radiation in a projected picture which serves as a viewing screen in connection with the point source localization arrangement.

The known collimators generally consist of a lead plate provided with a plurality of channels or with a plurality of throughbores or the collimator may consist of a grid having a plurality of openings and being built up from lead lamellae. In the case of the known scanner which comprises a long, extending conical heavy lead structure as the collimator, this type of collimator is also called a conical lead diaphragm.

In the known collimator structures above described, the expression "collimator bore" is generally used as a collective term to embrace all kinds of collimator openings or passages. Depending on the geometrical form of the opening or passage and also depending especially on the density of radiation passing through the bore and on the length of the bore as well as on the width of the bore, the known collimators have a characteristic permeability which is recognized in the art and is called the "geometrical sensitivity of the collimator." As a result of this geometric sensitivity, a certain sharpness of the picture is achieved depending upon the solid angle for which the collimator is radiation permeable. The picture sharpness which is achieved equals that which can be obtained for a radiation point source lying at a certain distance from the site under examination. In this manner, a high degree of sharpness of the picture, for example, a high geometric resolution of a collimator is always obtained at the cost of the geometric sensitivity, and this will be explained further later in more detail in connection with the description and with the present invention on the basis of the drawings.

THE PROBLEM SOLVED BY THE PRESENT INVENTION

A diagnostic instrument equipped with a certain collimator consequently has a predetermined, unchangeable sharpness of the picture and geometric sensitivity. Depending on the type of investigation, often, however, a higher sharpness of the picture, of in other cases a higher sensitivity is desired, which hitherto had been taken into consideration by assigning geometrically variable and exchangeable collimators to a diagnostic device. The exchange of the relatively heavy collimator plates, however, is very cumbersome and time-consuming and for these reasons generally cannot be carried out during the course of an investigation. Beyond that, the exchange of collimator plates merely permits a step by step change of the sharpness of the picture and of the sensitivity which is a time-consuming adjustment. In addition, in the case of the scintilligraphic investigation, where the radiation intensity changes in the area of investigation and thus also the requirements of the sensitivity of the measuring arrangement during the examination, an exchange of the collimator plates is often not possible, since the changes take place in many cases too quickly to permit such change and because the patient must of necessity maintain his position fixed relative to the detector system during the entire examination procedure.

OBJECT OF THE INVENTION

In accordance with the above, an object of the invention is based on the task of creating a diagnostic device according to the definition of the apparatus species in the case of which means for adjusting the geometric sensitivity and the sharpness of the picture will insure that these will be adjustable continuously and easily during the examination operation.

Other and further objects will be seen from the summary, drawings and more detailed description below.

SUMMARY OF THE INVENTION

According to the invention, this objective is achieved through the critical factor that the collimator consists of two or more multi-channel collimator elements, the channels of which are mutually aligned coaxially and the further requirement that at least one collimator element is shiftable axially in relation to the other collimator element. In the case of such a collimator in accordance with the invention the distance between the collimator elements is added to the total length of the mutually aligned channels to thereby provide an additional collimating effect, for example, in the sense of the collimation achieved so that by pushing apart the collimator elements, the effective length of the channel is increased and thus the sharpness of the picture can be increased, while inversely, by pushing the elements together, the geometric sensitivity can be increased. According to one embodiment of the invention, provision can be made that the collimator elements are constructed as punched or perforated plates or in the form of an open lattice in a manner known per se, and in that the collimator consists of a basic collimator on the side of a detector with a great depth of the bore and of several moveable, relatively thin collimator elements so that the maximum adjusting distances of these elements may be limited in such a way, that the collimator will always remain exclusively permeable or open for certain trajectories of the beam, which pass through the bores which are aligned and mutually coaxial. This first type of embodiment is used preferably in the case of collimators which require a great septum thickness or wall thickness, since the maximally permissible distance between the collimator elements which have been pushed apart depends on the septum thickness as will be explained in greater detail later on. In this group of moveable thin element collimators belong, for example, such collimators as are required for taking pictures with the higher energy gamma rays. This group of collimators also includes those where the septum thickness is not determined by the energy of the gamma ray used, but by some other requirement for the collection of data at a limit of the apparatus. Such data exists for example, in the case of a gamma-ray-camera-detector, which consists of individual, small detector elements. In the case of these detectors there frequently is only a single bore in front of each detector element, so that the distance between the axes of the bores is equal to the distance between the centers of the individual detector elements. The diameter of the bores is determined according to the desired resolution capacity. The septum thickness resulting from the bore distance and the bore diameter is frequently greater than necessary for the absorption of penetrating gamma quanta and accordingly the moveable thin element collimator of the first type is needed. For the illustration of operation with low energy radiation sources, $E\gamma < 250$ keV, a second and different type of embodiment is preferred according to the present invention. This second embodiment is characterized in that, in the case of one or several collimator elements, the channels consist of protruding casings which are each attached on a perforated carrier plate, and which can each be pushed into the channels of the adjacent collimator elements in the manner of a telescope. In this case, the collimator elements always with a larger diameter of the channel can be disposed on the side of the detector whenever one wants to utilize the graduated conical shape of the channels, resulting from the telescopic structure, for an increase of the picture sharpness, or vice versa, the collimator elements can be disposed with the always larger diameter of the channel on the side facing away from the detector whereby the graduated conical shape of the channels is utilized for the increase of the geometrical sensitivity of the total collimator. According to a special development, provision can be made according to the invention that the collimator consists of two outside perforated plates always carrying equal casings on a main surface, and of a middle perforated carrying plate with casings protruding on both sides, the outside diameter of which is somewhat larger than the diameter of the casings of the outside perforated plate. In the case of this form of embodiment, the effective diameter remains the same on both sides of the collimator independent of shifting of the collimator elements. According to a further structural characteristic of the invention additional adjustment and guiding means may be provided so that the moveable collimator plates are guided without clearance on guide bars and are adjustable by way of a spindle drive.

BRIEF DESCRIPTION OF THE DRAWING

The invention will be explained in more detail in the following paragraphs on the basis of the drawings.

DETAILED DESCRIPTION OF THE PREFERRED EMBODIMENTS

Figure 1:
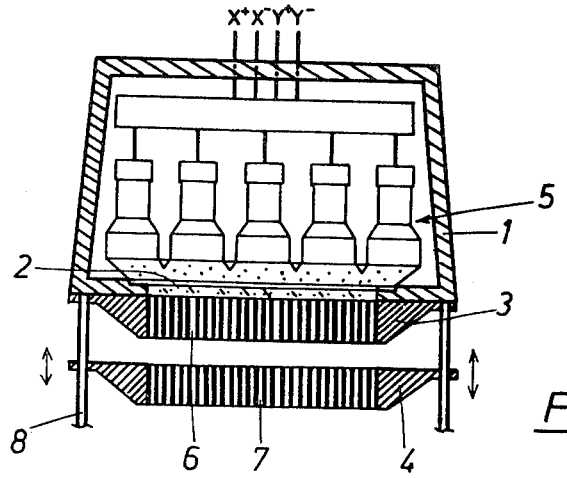
FIG. 1 shows a measuring head of a diagnostic device developed as a gamma camera with a fixed and a shiftable collimator plate according to a first embodiment of the invention.

FIG. 1 shows the measuring head of a nuclear medical, diagnostic instrument with a detector 2 disposed in a window of a lead screen 1, made, for example, of NaJ (TL)-crystal. The radiation which is to be examined with regard to a distribution pattern, hits the detector through the channels of a collimator, whereby the collimator in the case of the embodiment consists of two multi-channel collimator plates 3,4, which have an identical picture of channel holes aligned with one another. A localization arrangement given altogether the position number 5 is series connected to the detector 2, which localizes the detector areas hit by the gamma radiation and which delivers the signals for triggering an oscillograph via the outlets $X^+X^-Y^+Y^-$, the picture points of which are registered by a camera. The collimator plate 4 is shiftable continuously in an axial direction of the collimator plate channels 6,7 on guide bars 8 via, for example, a spindle drive, as a result of which the geometric sensitivity and sharpness of the picture is continuously changeable during operation, which will still be explained in more detail subsequently.

Figure 2:
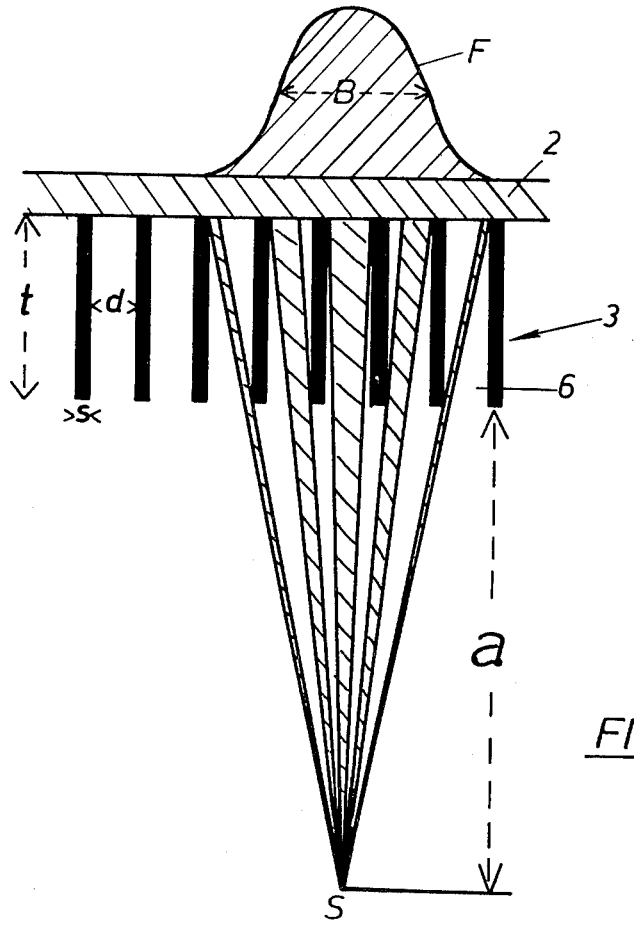
FIG. 2 is a schematic diagram referred to for the explanation of the geometric sensitivity and of the sharpness of a picture in a collimator.

FIG. 2 illustrates schematically the collimation conditions in the case of a single collimator plate 3 and explains the important values for the geometry of the scintilligraphic pictures. These are the collimator thickness or synonymously, the depth of bore $t$, the diameter $d$ of the channels and bores 6 and a distance $a$ of the source of radiation from the lower surface of the collimator 3. Furthermore, the minimum septum thickness $s$ is of importance, which gives the thickness of the wall between the bores which can still be penetrated with sufficiently little probability by the gamma quanta of the used energy. An additional important value is the density of bores, for example, the number of bores on a surface unit which is a function of $d$ and $s$. The higher the density of bore, the greater will be the quanta yield and thus the permeability of the collimator. The permeability of the collimator is designated as the geometric sensitivity. In FIG. 2 the area of the curve F presents a measure for the geometric sensitivity of the collimator, whereas the half value width B of the surface enclosed by the surface F represents a measure for the sharpness of picture of the collimator. For a source of radiation S lying at a certain distance $a$ from the collimator 3, one collimator plate has a certain and characteristic geometric sensitivity and a certain sharpness of picture or sharpness of definition.

Figure 3:
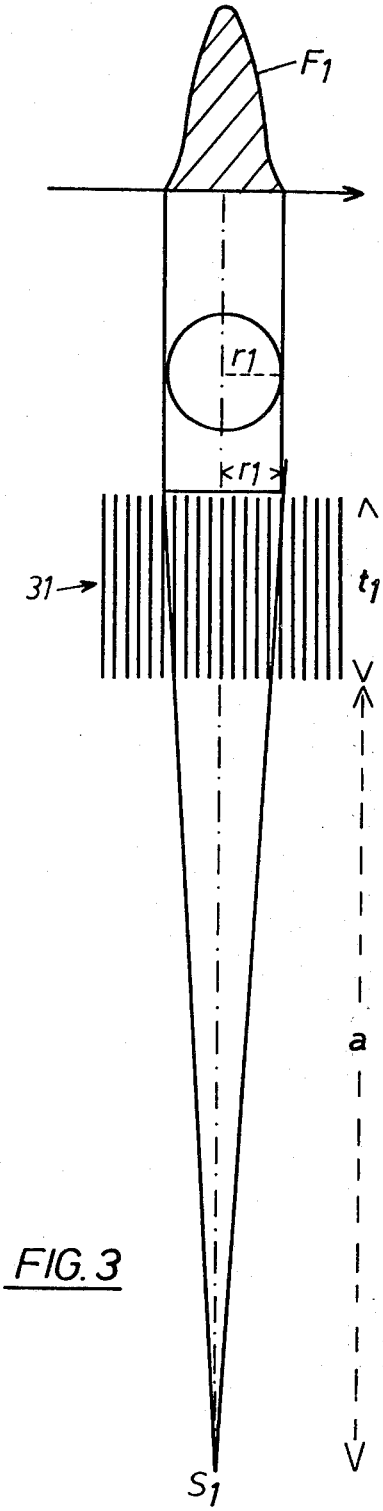
FIGS. 3 and 4 each are a schematic diagram for the explanation of the dependence of the geometric sensitivity and sharpness of a picture of a collimator on the length of its channels and the depth of its bore.
Figure 4:
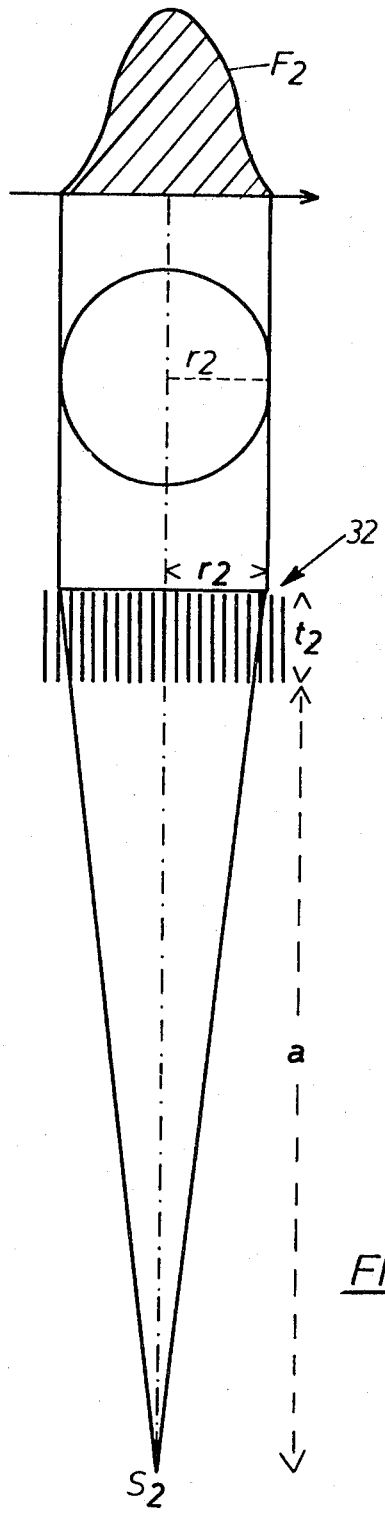

FIGS. 3 and 4 illustrate the dependence of the geometric sensitivity and of the sharpness of definition of the collimator on the depth of the bore. In the case of the collimator 31 according to FIG. 3, the depth of bore $t_1$ is twice as large as the depth of bore $t_2$ of the collimator 32, according to FIG. 4, while otherwise the same geometric conditions are present. Because of the greater depth of bore $t_1$, the collimator is permeable still only for a solid angle with the radius $r_1$ for the source of radiation $S_1$, while the source of the radiation point $S_2$ can irradiate the detector crystal through the collimator 31 at a solid angle with about twice as large a radius $r_2$. Correspondingly, the point source $S_2$ in a good approximation irradiates the four-fold detector surface. The cut through the local quantum distribution (curves $F_1$, $F_2$) of the quanta striking the detector crystal, shows that approximately four times as many quanta can be proven in the case of the same strength of source and the same time of observation in the detector crystal of the arrangement according to FIG. 4. In this case, it is valid generally that the geometric sensitivity of a collimator decreases with the square of its depth of bore $t$. The sharpness of definition on the contrary measured on the width of the local quantum distribution in the detector crystal increases with the depth of bore.

Figures 5, 6:
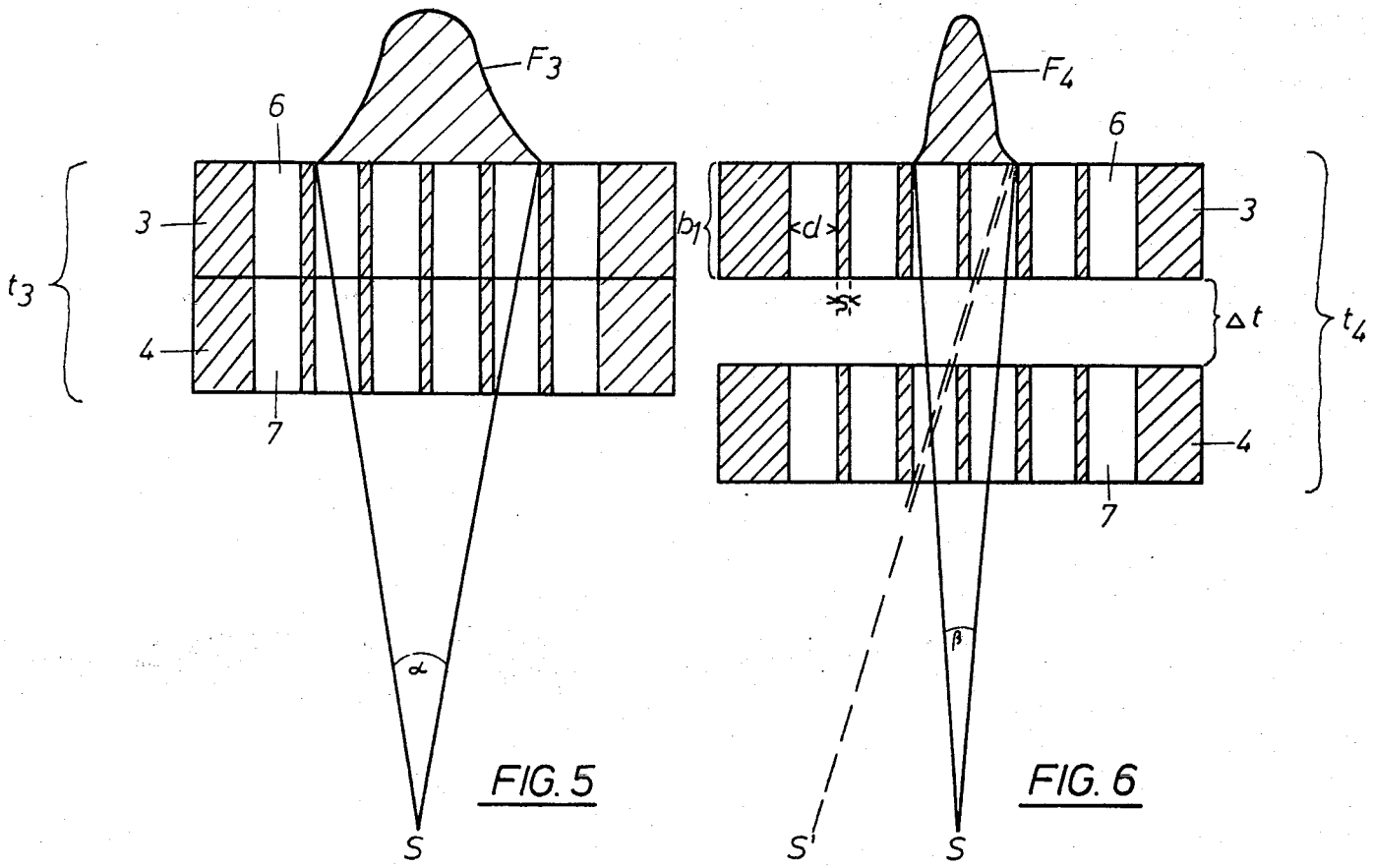
FIGS. 5 and 6 show two schematic diagrams for the explanation of the collimator conditions for two variable adjustments of the collimator in the case of the embodiment according to FIG. 1.

FIGS. 5 and 6 explain for the embodiment according to FIG. 1 how the geometric sensitivity and the sharpness of definition of the collimator arrangement can be changed by changing the distance between the two collimator plates 3 and 4. In FIG. 5 the two collimator plates 3 and 4 are pushed directly against one another, after which the collimator becomes permeable for a solid angle $\alpha$ and the cross-section which is curve $F_3$ as cut through the local quantum distribution shows a high geometrical sensitivity with a relatively slight decrease in the desired geometrical resolution. In FIG. 5 the effective collimator depth $t_3$ is the sum of the depths of the bores of the two channels 6 and 7.

In FIG. 6, the two collimator plates 3 and 4 are pushed apart by a distance of $\Delta t$, as a result of which the displacement $\Delta t$, in view of the collimation conditions, is added to the axial length of the channels 6 and 7, and a clearly enlarged effective depth of bore $t_4$ results as compared with $t_3$. The radiation source S irradiates in the manner shown in towards the detector crystal right through the collimator at only a relatively small solid angle $\beta$, which to be sure leads to a decrease of the geometric sensitivity but on the other hand to a substantial increase of the sharpness of definition.

The quantum distribution (curve $F_4$), changed as compared to FIG. 5, results in the position according to FIG. 6 not only as a result of the enlargement of the effective depth of bore $t_4$ by $\Delta t$, but with a slight portion also as a result of the change of the distance of the source of radiation S from the underside of the collimator plate 7. A decrease of this distance will lead additionally to an increase of the sharpness of definition, while in that case the geometric sensitivity remains essentially unchanged.

In the case of the embodiment of the variable collimator according to FIGS. 1, 5, and 6, one must however note, that the possible paths of the rays pass exclusively through bores aligned coaxially with one another, since otherwise side rays will disturb the picture in a sensitive manner. Such side rays are recorded, for example, in FIG. 6 starting out from point $S^1$.

In FIG. 6, the distance $\Delta t$ between the two collimator plates 3, 4 is enlarged beyond the permissible measure. In order to avoid such side rays, the formula relating to the problem is as follows:

$$\Delta t_{max} = (s/d) \times b_1, \quad (1)$$

In this formula the maximum distance is $\Delta t$, on the right hand side and $s$ = septum thickness, $d$ = diameter of bore, and $b_1$ = thickness of the collimator plate 3 which is closest to the detector.

According to the preceding formula, (1) the maximum distance between two collimator plates is proportional to the ratio between the septum thickness $s$ and the diameter of bore $d$. This last named ratio in the case of low energy radiation sources is so small, that the extension which can effectively be achieved in the case of a collimator of only two plates amounts to only a fraction of the length of the element close to the detector. In order to meet this requirement for extension according to FIGS. 5 and 6, the embodiment is provided and covers the case in which the extension of the collimator is brought about by a small change of the free distance between two adjacent collimator elements. This embodiment of the invention is suitable predominantly for collimators which require a relatively great septum thickness *s*. This is true, for example, with collimators used for taking a picture with higher energy gamma quanta.

Figure 7:
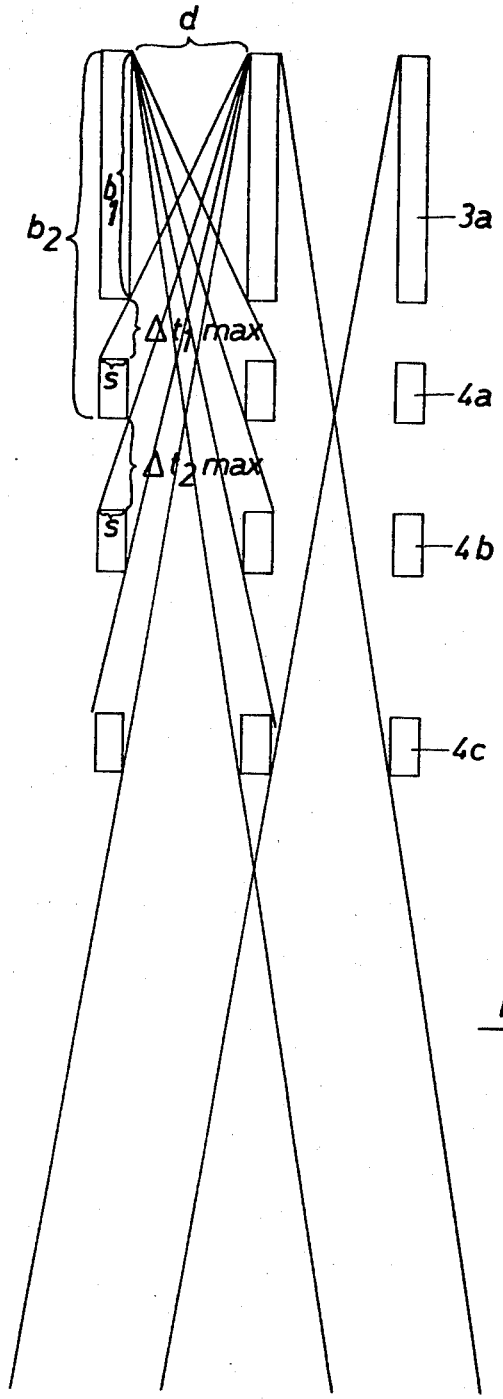
FIGS. 7 and 8 show in simplified schematic and diagrammatic presentation two embodiments of collimators which are predominantly suitable for pictures with high energetic radiation sources.
Figure 8:
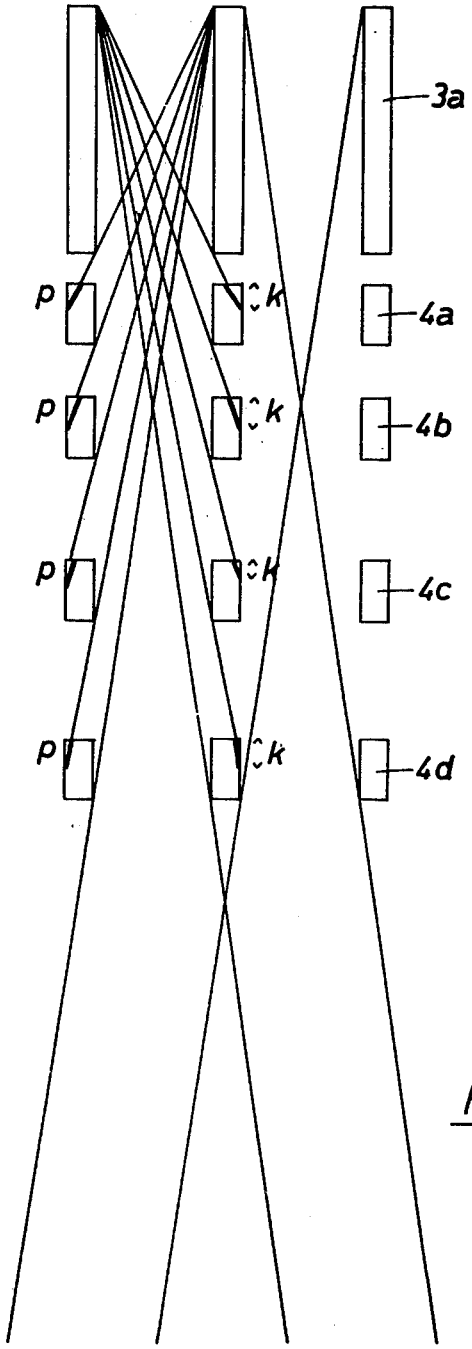

For these cases of application in solution to the problem shown in FIGS. 5 and 6 the collimator arrangement of the invention is provided in accordance with FIGS. 7 and 8 consisting of a plurality of elements. According to FIGS. 7 and 8, this need to assuredly provide small displacement a unique collimator is shown. This embodiment of collimator consists of a plurality of elements according to the FIGS. 7 and 8 which have a longer base collimator 3*a* on the side of the detector and which have a larger number of relatively thin moveable elements 4*a*, 4*b*, 4*c*, and possibly 4*d* than in the embodiment of FIGS. 5 and 6. In this arrangement the permissible maximum distance $\Delta t_1$max between the two elements 3*a* and 4*a* is calculated according to the above mentioned formula (1). The maximum permissible distance between the second and the third element 4*a* and 4*b* is calculated according to the formula $$\Delta t_2 \max = (s/d) \times b_2, \qquad (2)$$

wherein $b_2$ is the effective width of the collimator part comprising the two first elements. The maximum permissible distances between the additional elements can be calculated analogously. These calculations are valid only on the assumption that lead is impermeable for gamma quanta even in the smallest thickness of a layer. Since in reality gamma rays penetrate certain small thicknesses of lead, the maximum distances between the individual collimator elements must be limited to somewhat smaller values that will result from the preceding formula.

FIG. 8 shows a collimator built up of a basic collimator 3*a* and four movable elements 4*a*, 4*b*, 4*c*, and 4*d* in the fully pulled out or extended state. In the fully extended case consideration must be given to the fact that the distances between the elements must be decreased always by extensions *k* in view of the path *p* of penetration into the lead layer.

In the case of the extension of variable collimators, the movement of the elements must be run in a coordinated manner. This coordination of the movement in an advantageous manner can be achieved by selecting various spindles of variable pitch. By means of suitable mechanical devices, care can be taken of the fact that there will always be one pair of spindles which will move one collimator element, while it serves as a guide for the remaining collimator elements thereby preventing tilting or canting.

Figure 9:
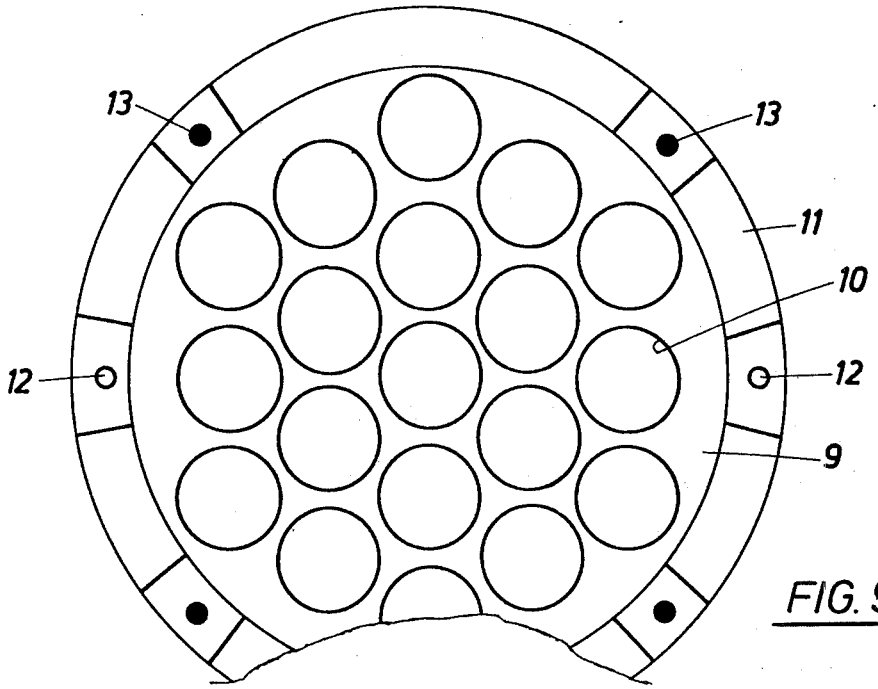
FIG. 9 shows in schematic presentation and in top view a full-walled collimator plate provided with bores of passage.
Figure 10:
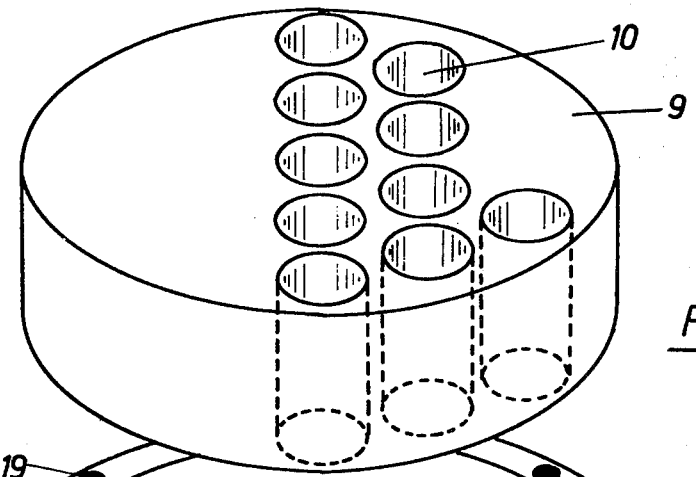
FIG. 10 shows in perspective, simplified presentation the middle range of the bore of the collimator plate according to FIG. 9.

FIGS. 9 and 10 illustrate in a simplified schematic presentation a collimator plate 9 which is made of a full disc in which are provided numerous bores or channels 10. Six of these channels are always disposed hexagonally around a central channel. For a picture with a gamma quanta of 140 keV, a septum thickness of fractions of 1 millimeter will suffice. On a collimator surface with a radius of about 12 cm, several thousand bores 10 are thus accommodated. FIG. 9 further illustrates the edge 11 of the attachment of the collimator disc 9 in which the bores 12 are provided for the reception of the guide bars 8 and furthermore in which they are also provided bores 13 for the reception of restraining or stop means on the terminal side of adjusting spindles.

Figure 11:
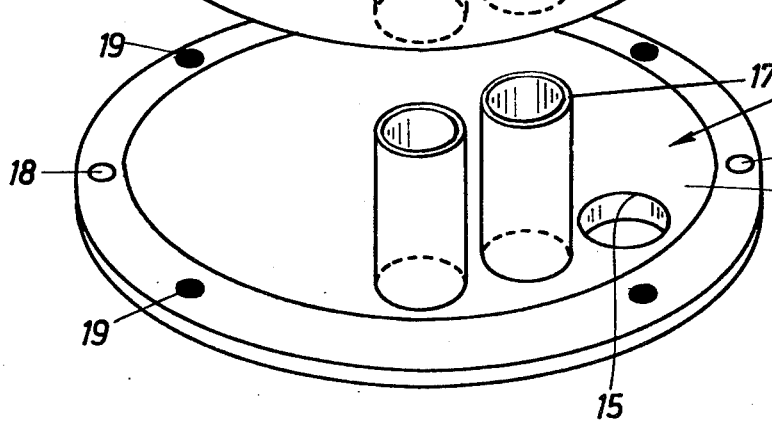
FIG. 11 shows in perspective presentation a second collimator plate which can be inserted in the manner of a telescope into the collimator plate according to FIGS. 9 and 10.
Figure 12:
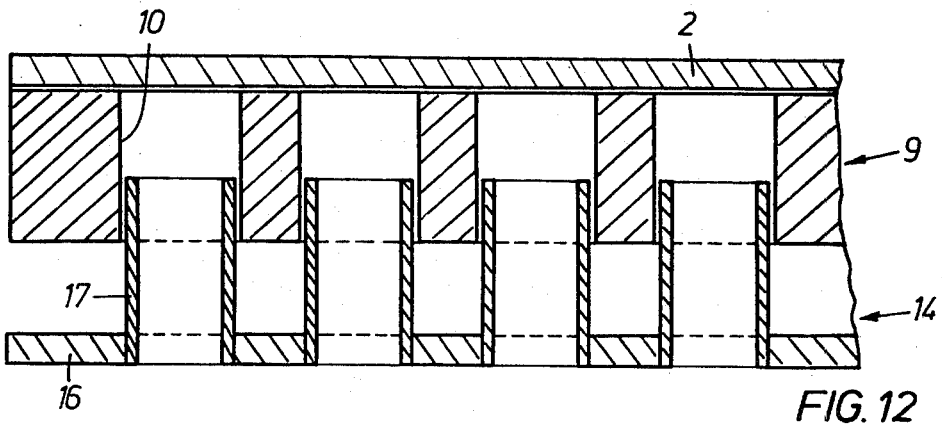
FIG. 12 shows a partial cut through a collimator consisting of the two collimator plates according to the FIGS. 10 and 11.

The additional collimator plate 14 shown in FIG. 11, is assigned to the collimator plate 9, which plate 14 consists of a flat carrying plate 16 provided with holes 15 into which the holes of casings 17 are inserted at their lower ends. The outside diameter of the casings 17 is somewhat smaller than the inside diameter of the bores 10, so that the casings 17 can be pushed in the manner of a telescope into the bores 10 of the collimator plate 9, as illustrated in FIG. 12.

The carrying plate 16 of the collimator plate 14 is likewise provided at its edge with a guide bore 18 for the reception of guide bars and with guide bores 19 for the reception of the adjusting spindles. In case of the embodiment according to FIG. 12, the collimator plate 9 facing the detector crystal is disposed fixedly, whereas the collimator plate 14 provided with the casings 17 is shifted in order to change the effective total depth of the bores of passage on the guide bars.

Figure 13:
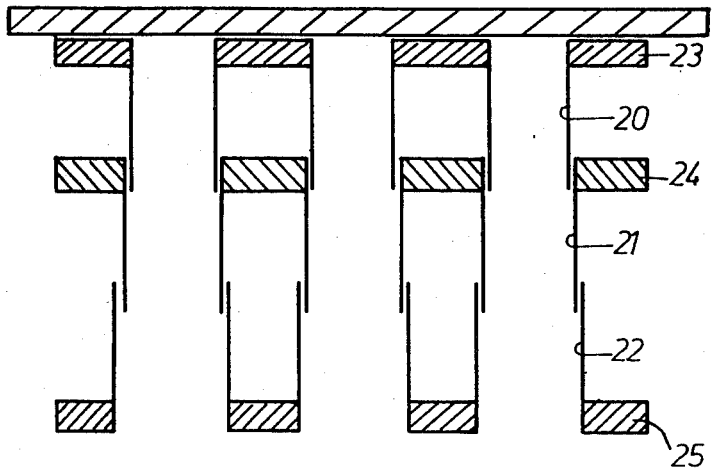
FIG. 13 shows a collimator in a pulled out state consisting of three collimator plates which can be pushed into one another in the manner of a telescope.
Figure 14:
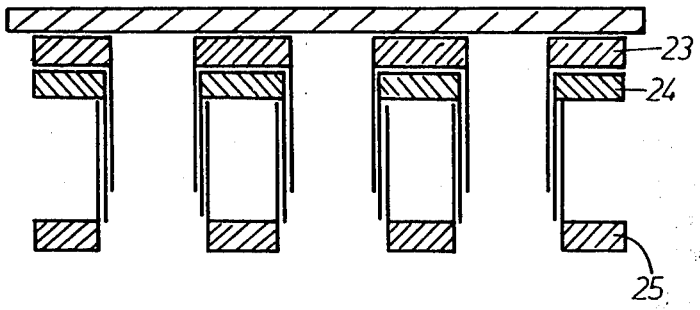
FIG. 14 shows the collimator according to FIG. 13 in a pushed together state.

In principle, the variable collimator can consist of a large plurality of plates shiftable in relation to one another. An embodiment is also practical in the case of which no full-walled collimator plate 9 according to FIG. 9 is used, but in the case of which all collimator plates consist of elements provided with protruding casings. The FIGS. 13 and 14 illustrate such an embodiment in the case of which three collimator elements 23, 24, 25 always provided with casings 20, 21, 22 have been provided the casings of which can be pushed into one another in the manner of a telescope. FIG. 13 shows the collimator element or their casings in a pulled apart position, while in FIG. 14 the collimator elements are pushed closely into one another.

Figure 15:
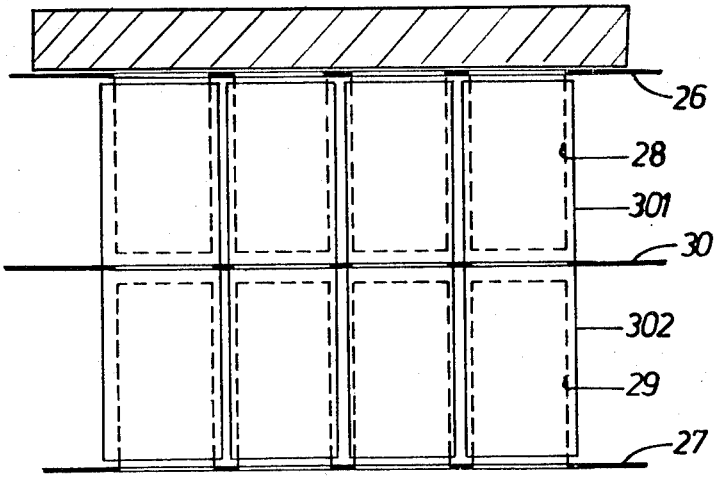
FIG. 15 shows another embodiment of the collimator.
Figure 16:
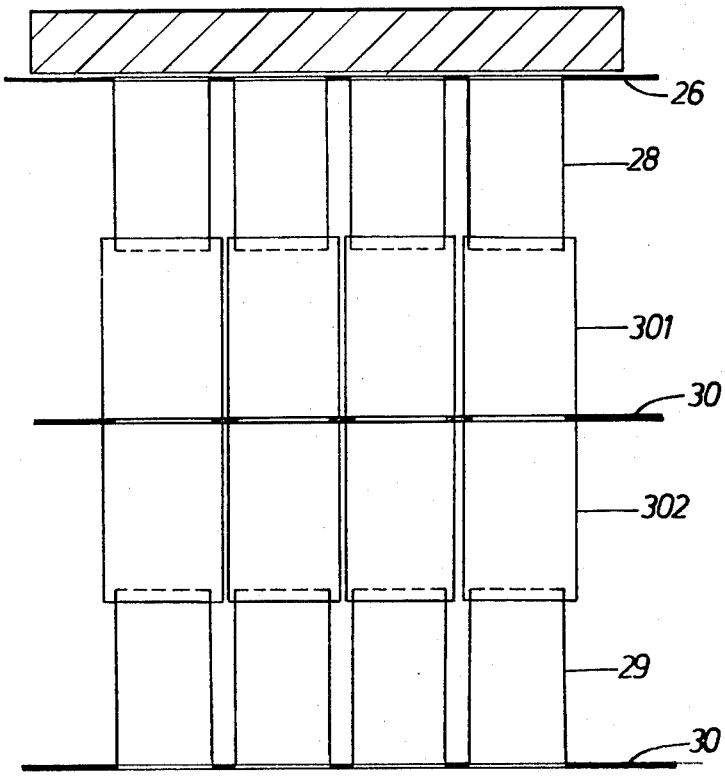
FIG. 16 shows the collimator according to FIG. 14 in a pulled out state.

FIGS. 15 and 16 show a collimator consisting of three elements which can be pushed into one another in the manner of a telescope. The two outside elements 26,27 are developed identically and always consist of a perforated plate which carry casings 28, 29 on the main surfaces facing each other and which are aligned with one another. The middle element 30 consists of a carrier plate with casings 301, 302 protruding on both sides, the diameter of which is somewhat larger than the diameter of the casings 28, 29 so that the parts can intermesh in the manner of a telescope and in the manner shown. In the case of this embodiment the effective diameter of the bore remains constant at both sides of the collimator independently of the shifting of the elements. This collimator which only has very thin septa and is suitable for making pictures with low energy gamma quanta, for example, the 140 keV quanta of the $99_{tc}$m. (Technetium)

The invention is not limited to collimators with the round bore as shown in cross section, but in the same way be extended to variable collimators with cross-section square, triangular cross section and hexagonal bores. Likewise, the advantages of the invention can be realized by the use of latticelike collimators which are built up from lead lamellae.

From the above it is seen that the diagnostic instrument probably consists of the combination of direct and localizing means for gamma quanta from a source in the body which is a radioactive source. The multi-channel collimator elements are placed in alignment to permit an array collimator for accurate pattern resolutions.

Having thus disclosed the invention, I claim:

1. A nuclear medicine diagnostic instrument for the determination of the distribution pattern of gamma ray emission of radioactive substances serving as a gamma ray source inserted into a body and emitting gamma quanta, said instrument consisting essentially of:

the combination of a detector and an adjustable collimator means, said collimator means consisting of a plurality of multichannel collimator elements placed between the source and said detector to thereby form a distribution pattern for localizing said gamma quanta from said source in the body;

said collimator elements being formed of perforated plates and further comprising at least one moveable collimator element, said elements lying on the source side of the collimator means and being axially shiftable;

each of said plurality of collimator elements having its respective channels in mutual alignment and coaxial alignment with a neighboring channel in another collimator element to provide at least a pair of coaxially aligned collimator elements in the array; and adjustment means including limiting means for maximum adjustment to axially shift one of the said collimator elements relative to the neighboring collimator element and to maintain alignment of the elements whereby improvement in definition and sensitivity is achieved in the pattern of radiation.

2. A nuclear medicine diagnostic instrument for the determination of the distribution pattern of gamma ray emission of radioactive substances serving as a gamma ray source inserted into a body and emitting gamma quanta, said instrument consisting essentially of:

the combination of a detector and an adjustable collimator means, said collimator means consisting of a plurality of multichannel collimator elements placed between the source and said detector to thereby form a distribution pattern for localizing said gamma quanta from said source in the body;

said collimator elements being formed of perforated plates and further consisting of several moveable and relatively thin collimator portions having a longer base on the detector side of the perforated plate for a greater depth of bore on the detector side than on the source side;

each of said plurality of collimator elements having its respective channels in mutual alignment and coaxial alignment with a neighboring channel in another collimator element to provide at least a pair of coaxially aligned collimator elements in the array; and adjustment means including limiting means for maximum adjustment to axially shift one of the said collimator elements relative to the neighboring collimator element and to maintain alignment of the elements whereby improvement in definition and sensitivity is achieved in the pattern of the radiation.

3. A nuclear medicine diagnostic device as claimed in claim 1, characterized in that said moveable collimator portions of said moveable relatively thin collimator elements have channels which consist of protruding casings which are attached to said perforated carrying plate, and said adjustment means further includes pushing means whereby the casings can be pushed in the manner of a telescope into the channels of the adjacent collimator element.

4. A nuclear medicine diagnostic device as claimed in claim 3, characterized in that the combination of collimator elements and adjustment means further includes two outside perforated plates casings of substantially identical shape or one main surface of the perforated plate and a middle perforated plate and a middle perforated carrying plate which is provided with similarly shaped casings protruding in both sides thereof, the outside diameter of the middle casings being larger than the diameter of the casings of the outside perforated plates.

5. A nuclear medicine diagnostic device as claimed in claim 4 including a spindle and guide bars for said shifting means said guide bars guiding the moveable collimator elements without protruding from the casings and said shifting means by adjustable means of said spindle drive.

* * * * *